US006720043B1

(12) United States Patent
Sismondi et al.

(10) Patent No.: US 6,720,043 B1
(45) Date of Patent: Apr. 13, 2004

(54) RECEIVING SHEET FOR INK-JET PRINTING COMPRISING A GELATIN AND SACCHARIDES COMBINATION

(75) Inventors: Alain Dominique Sismondi, Nice (FR); Andrea Novelli, Savona (IT); Domenico Marinelli, Savona (IT); Giuseppe Loviglio, Savona (IT)

(73) Assignee: Ferrania, S.p.A., Ferrania (IT)

( * ) Notice: Subject to any disclaimer, the term of this patent is extended or adjusted under 35 U.S.C. 154(b) by 0 days.

(21) Appl. No.: 09/642,339

(22) Filed: Aug. 21, 2000

(30) Foreign Application Priority Data

Sep. 3, 1999 (IT) ..... SV99A0027

(51) Int. Cl.[7] ..... B41M 5/00

(52) U.S. Cl. ..... 428/32.27; 428/32.24; 428/32.38

(58) Field of Search ..... 428/195, 478.2, 428/532, 32.24, 32.27, 32.38

(56) References Cited

U.S. PATENT DOCUMENTS

| | | | | |
|---|---|---|---|---|
| 3,889,270 A | | 6/1975 | Hoffmann et al. | 346/1 |
| 4,379,804 A | | 4/1983 | Eisele et al. | 428/332 |
| 5,141,599 A | | 8/1992 | Jahn et al. | 162/137 |
| 5,254,403 A | | 10/1993 | Malhotra | 428/323 |
| 5,320,897 A | * | 6/1994 | Kondo et al. | 428/195 |
| 5,418,078 A | | 5/1995 | Desie et al. | 428/704 |
| 5,472,930 A | | 12/1995 | Podszun et al. | 503/214 |
| 5,474,843 A | | 12/1995 | Lambert et al. | 428/327 |
| 5,801,116 A | * | 9/1998 | Cottrell et al. | 502/404 |
| 5,804,320 A | | 9/1998 | Tomioka et al. | 428/478.2 |
| 5,882,755 A | * | 3/1999 | Igarashi et al. | 428/41.8 |
| 5,897,961 A | | 4/1999 | Malhotra et al. | 428/537.5 |

FOREIGN PATENT DOCUMENTS

| | | |
|---|---|---|
| EP | 0667245 | 8/1995 |
| EP | 0709224 | 1/1996 |
| EP | 0732218 | 9/1996 |
| GB | 2323800 | 10/1998 |

OTHER PUBLICATIONS

Abstract for Japanese Patent JP05016517; Entitled: Recording Sheet and Recording Matter; Inventors: Hasegawa Takafumi, Sumita Katsutoshi; Filed Jul. 01, 1991, Published Jan. 26, 1993.

Abstract for Japanese Patent JP06064306; Entitled: Ink Jet Recording Sheet; Inventors: Abe Yasumine, Ashida Tetsuya, Tsubaki Masayuki; Filed 108/21/92, Published Mar. 8, 1994.

* cited by examiner

*Primary Examiner*—B. Hamilton Hess
(74) *Attorney, Agent, or Firm*—Mark A. Litman & Assoc. P.A.

(57) ABSTRACT

The present invention refers to an ink jet receiving sheet for ink-jet printers comprising a support and at least one ink receiving layer, wherein said ink receiving layer comprises a binder selected from the group consisting of gelatin and gelatin derivatives and at least one saccharide derivative selected from the group consisting of mono-, oligo-, or poly-saccharides as additive agents to improve glossiness.

12 Claims, No Drawings

RECEIVING SHEET FOR INK-JET PRINTING COMPRISING A GELATIN AND SACCHARIDES COMBINATION

FIELD OF THE INVENTION

The invention relates to an ink receptor for ink jet printers, and more particularly, to ink receptor containing a combination of gelatin binder and a saccharide as additive agent to improve glossiness.

BACKGROUND OF THE INVENTION

Ink jet printing has become increasingly popular, particularly for so-called "desk-top publishing", because of its capability to produce small volumes of printed matter from digital input at high throughput speeds. Recent equipment developments have led to the introduction of multi-color ink jet printers that integrate colored graphics and text. To some extent, however, the applications of ink jet printing have been limited due to the demanding requirements the ink receptors must meet in order to provide high quality text and graphics.

Glossiness is associated with the capacity of a surface to reflect more light in some directions than in others and is defined as the quantity of reflected light measured at a predetermined angle (generally at 20°, 60° or 85°) respect to incident light and is expressed in percentage.

JP Patent Application 5-16517, 2-289375 and 6-64306, DE Patent Application 2,234,823, and U.S. Pat. No. 4,379,804 disclose methods in which gelatin is used in ink-receiving layers of ink-jet receiving sheets. From these, it has become clear that gelatin has an advantageous function for the absorption of ink solvents. The gelatin is to improve smudge resistance and increase definition quality.

U.S. Pat. No. 5,141,599 discloses a receiving material for ink-jet printing including a polyolefin coated base paper and an ink receiving layer applied on the front face thereof, and the receiving layer containing a mixture of gelatin and starch of a grain size of less than about 20 $\mu$m, and wherein the ratio of gelatin to starch ranges from 1:1 to 10:1. The receiving material so produced has a glossy surface achieved by as few work processes as possible, avoiding the necessity for additional smoothing processes. One of the forms preferred for the ink receiving layer additionally contains a copolymer containing polar groups such as an acrylate copolymer containing carboxyl groups, metal combined carboxyl groups and/or nitrile groups or a carboxylized vinylidene copolymer.

U.S. Pat. No. 5,804,320 discloses a receiving medium which comprises an ink-receiving layer comprising a pigment and an alkali-process gelatin, wherein said gelatin has no sol-gel reversibility at room temperature and has an average molecular weight within the range from 50,000 to 150,000. High image density and resolution, sharp color tone and good ink absorptivity are obtained.

U.S. Pat. No. 5,254,403 describes a receiving sheet which comprises a substrate and an image receiving layer comprising a mixture of (a) a polymer (b) a polysaccharide; and (c) a polymer containing oxyalkylene monomers to provide receiving sheets that enable the formation of images with high optical density with minimum intercolor bleed.

EP Patent Application 667,245 describes receiving sheets for ink jet printing containing monosaccharides, oligosaccharides or alcohols, having rapid drying times and being resistant to curling.

U.S. Pat. No. 5,474,843 discloses an ink receiving sheet forming quick-drying, water-resistant, light-stable ink prints with aqueous inks. The material comprises a support such as a polyester film and a coated layer containing a water-soluble mordant that forms insoluble compounds with and immobilizes the dyestuffs of the inks and a hardened polymer, preferably, hardened gelatin, which contains polymeric beads that protrude from the layer. A highly preferred hardenable polymer is gelatin. Other preferred polymers include chitosan and 100% hydrolyzed polyvinyl alcohol. Chitosan is a linear biopolymer, specifically a polysaccharide which comprises two monosaccharides, N-acetyl-D-glucosamine and D-glucosamine linked by β-glycosidic bonds. Said polymers can yield a finished surface of high gloss.

U.S. Pat. No. 5,472,930 discloses a thermosensitive receiving material containing a mono-, oligo- or polysaccharide and a catalyst in one or more binder layers arranged on a transparent support. A black-and-white image with high optical density, good gray step reproduction, great sharpness and good stability is formed when the material is heated imagewise, e.g. by means of a thermohead.

SUMMARY OF THE INVENTION

The present invention relates to an ink jet receiving sheet comprising a support and at least one ink receiving layer, wherein said ink receiving layer comprises a binder selected from the group consisting of gelatin and gelatin derivatives and at least one saccharide derivative selected from the group consisting of mono-, oligo-, or poly-saccharides as additive agent to improve glossiness.

DETAILED DESCRIPTION OF THE INVENTION

A first essential element of the ink jet receiving sheet according to the present invention is the use of gelatin or gelatin derivatives as binder component of the ink receiving layer(s).

Any gelatin made from animal collagen can be used, but gelatin made from pig skin, cow skin or cow bone collagen is preferable. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives (for example, gelatin derivatives disclosed in JP Patent Publications 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB Patents 861,414 and 103,189) can be used singly or in combination.

The gelatin binder is preferably added to the ink receiving layer(s) in a total amount of from 1 to 20 g/m$^2$, and more preferably from 2 to 10 g/m$^2$. When preparing the ink jet receiving sheet by coating a plurality of ink receiving layers, each ink receiving layer comprises an amount of gelatin binder ranging from 0.5 to 10 g/m$^2$.

The second essential element according to the present invention is the use of mono-, oligo-, and poly-saccharides as additive agents to improve glossiness in the ink receiving layer(s). The saccharide derivatives can comprise a recurring unit comprising five or six carbon atoms. The saccharide derivatives can be hydrogenated or non-hydrogenated. Preferred recurring units include, for example, glucose, xylose, mannose, arabinose, galactose, sorbose, fructose, fucose, adonitol, arbitol, inositol, xylitol, dulcitol, iditol, lactitol, mannitol, sorbitol, and the like. The average molecular weight of the saccharide derivatives ranges from 1,000 to 500,000, preferably from 1,000 to 30.000.

Hydrogenated and non-hydrogenated saccharide derivatives useful in the present invention are commercially available, for example, under the trade designation POLYSORB™ or GLUCIDEX™, from Roquette, Lille, France. The preparation of hydrogenated and non-hydrogenated saccharides usually starts from natural products (such as starch, agar, tragacanth gum, xanthan gum, guar gum, and the like) by means of enzymatic processes (to reduce the average molecular weight) and of reducing processes (to saturate the molecule, in case of hydrogenated saccharides).

The above mentioned saccharide derivatives are added to the ink receiving layer(s) in an amount ranging from 0.1 to 5 g/m$^2$, preferably from 0.5 to 3 g/m$^2$. When preparing the ink jet receiving sheet by coating a plurality of ink receiving layers, each ink receiving layer comprises an amount of saccharide derivatives ranging from 0.05 to 2.5 g/m$^2$.

Examples of suitable polysaccharides as additive agents to improve glossiness include (1) cellulose ester salts, such as sodium salts of cellulose phosphate ester (including those available from James River Chemicals), cellulose phosphate, available from CTC organics, sodium cellulose sulfate, available from Janssen Chimica, cellulose carbonate, available from Sigma Chemicals, sodium ethyl cellulose (which can be obtained by the reaction of alkali cellulose with sodium chloroethane sulfonate), and the like; (2) cellulose ethers and their salts, such as sodium carboxymethylcellulose (including CMC 7HOF, available from Hercules Chemicals Company), sodium carboxymethylhydroxyethyl cellulose (including CMHEC 43H.TM. and 37L, available from Hercules Chemical Company; CMHEC 43H™ is believed to be a high molecular weight polymer with carboxymethyl cellulose (CMC)/hydroxyethyl cellulose (HEC) ratio of 4:3, and CMHEC 37L is believed to be a lower molecular weight polymer with a CMC/HEC ratio of 3:7, carboxymethylmethyl cellulose, available from Aqualon Company, carboxymethyl cellulose calcium salt, available from Pfaltz and Bauer Inc., carboxymethyl cellulose ether sodium salt, available from E. M. Science Company, carboxymethyl cellulose hydrazide, available from Sigma Chemicals, sodium sulfoethyl cellulose (which can be prepared by the reaction of sodium vinyl sulfonate with alkali cellulose), and the like; (3) cationic cellulose ethers, such as diethyl aminoethyl cellulose (including DEAE cellulose, available from Poly Sciences Inc.), cationic hydroxyethyl celluloses, such as diethyl ammonium chloride hydroxyethylcellulose and hydroxypropyl triethyl ammonium chloride hydroxyethylcellulose (available as Celquat H-100 and L-200 from National Starch and Chemical Company and as Polymer JR series from Union Carbide Company), and the like; (4) hydroxyalkyl celluloses, such as hydroxyethyl cellulose (Including Natrosol 250 LR, available from Hercules Chemical Company), hydroxypropyl methyl cellulose, such as Methocel™ K35LV, available from Dow Chemical Company, hydroxypropyl hydroxyethyl cellulose, available from Aqualon Company, dihydroxypropyl cellulose (which can be prepared by the reaction of 3-chloro-1,2-propandiol with alkali cellulose), and the like; (5) substituted deoxycelluloses, such as chlorodeoxycellulose (which can be prepared by the reaction of cellulose with sulfuryl chloride in pyridine and $CHCl_3$ at 25° C.), amino deoxycellulose (which can be prepared by the reaction of chlorodeoxycellulose with a 19% alcoholic solution of ammonia for 6 hours at 160° C.), deoxycellulose phosphate (which can be prepared by the reaction of tosyl cellulose with triethyl phosphate in dimethyl formamide at 85° C.), deoxy cellulose phosphonium salt (which can be prepared by the reaction of tosyl cellulose with tris(hydroxy methyl) phosphine), and the like; (6) dextran polymers, such as carboxymethyl dextran (including #16058, available from Poly Sciences Inc.), diethyl aminoethyl dextran, such as #5178, available from Poly Sciences Inc., dextran sulfate, available from Sigma Chemical Company, dextran sulfate potassium salt, available from Calibiochem Corporation, dextran sulfate sodium salt, available from Poly Sciences Inc., amino dextran, available from Molecular Probes Inc., dextran polysulfonate sodium salt, available from Research Plus Inc., and the like; (7) natural ionic gums and their modifications, such as alginic acid sodium salt (including #032, available from Scientific Polymer Products), alginic acid ammonium salt, available from Fluka Chemie AG, alginic acid calcium salt, available from Fluka Chemie AG, alginic acid calcium sodium salt, available from American Tokyo Kasel Inc., gum arabic, available from Sigma Chemicals, Carrageenan sodium salt, available from Gallard-Schless Inc., carboxymethyl hydroxypropyl guar, available from Aqualon Company, cationic gum guar, available as Celanese Jaguars C-14-S, C-15, and C-17 from Celanese Chemical Company, karaya gum, available from Sigma Chemicals, xanthan gum, available as Keltrol-T from Kelco division of Merck and Company, chitosan, available from Fluka Chemie AG, n-carboxymethyl chitin, and the like; (8) protein polymers, such as dimethylammonium hydrolyzed collagen protein, available as Croquats from Croda, agar-agar, available from Pfaltz and Bauer Inc., amino agarose, available from Accurate Chemical and Scientific Corporation, and the like; (9) n-carboxymethyl amylose sodium salt, available from Sigma Chemicals; and the like, as well as mixtures thereof.

The supports used in the ink jet receiving sheet of the invention include any conventional support for ink jet receiving sheet. A transparent or opaque support can be optionally used according to its final use. Useful examples of transparent support include films of polyester resins, cellulose acetate resins, acryl resins, polycarbonate resins, polyvinyl chloride resins, poly(vinylacetal) resins, polyether resins, polysulfonamide resins, polyamide resins, polyimide resins, cellophane or celluloid and glass plates. The thickness of the transparent support is preferably 10 to 200 $\mu$m. Useful examples of opaque supports include paper, coated paper, synthetic paper, resin-covered paper, pigment-containing opaque films or expanded films, even if synthetic papers, resin-covered papers or various films are preferred in view of glossiness or smoothness, or polyester films are preferred in view of touchiness or luxuriousness.

The base paper constituting the resin-covered paper useful in the invention is not specifically limited, and any conventional paper can be used, but a smooth paper used as a conventional photographic support is preferable. The pulp used for the preparation of the base paper, singly or in admixture, is constituted by natural pulp, reproduction pulp, chemical pulps such as hardwood bleached kraft pulp, softwood bleached kraft pulp, high yield pulps such as groundwood pulp or thermo-mechanical pulp, recycled pulps and non-wood pulps such as cotton pulp or synthetic pulp. These base papers may contain additives usually employed in paper manufacture such as a sizing agent, binders, fixing agents, yield-improving agents, cationated agents, paper stiffness enhancing agents, reinforcing agents, fillers, anti-static agents, fluorescent brightening agents or dyes. A surface sizing agent, a surface reinforcing agent, a fluorescent brightening agent, an antistatic agent and an anchoring agent may be coated on the surface of the material.

The thickness of the base paper is not specifically limited, but is preferably 10 to 200 μm. A base paper having a smooth surface is preferable, which is obtained by applying a pressure to or calendering the paper during or after papering. The weight of the base paper is preferably 30 to 250 g/m$^2$. The resin used in the manufacturing of resin-covered paper is preferably a polyolefin resin or a resin capable of being hardened with an electron beam. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigments such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox™ 1010 or Irganox™ 1076, blue pigments or dyes such as cobalt blue, ultramarine or phthalocyanine blue, magenta pigments or dyes such as cobalt violet, fast violet or manganese violet, a brightening agent and a UV absorber. These additives may be all suitably used in combination.

The resin-covered paper, which is the support preferably used in the present invention, is manufactured by the so-called extrusion method casting a thermally fused resin (for example, fused polyolefin) on the moving paper, whereby both surfaces of the paper are covered with the resin. When the paper is covered with a resin capable of being hardened with electron beam irradiation, the resin itself is coated with a conventional coater such as a gravure coater or a blade coater and then is irradiated with electron beam to harden the coated resin. Before the paper is coated with a resin, the surface of the paper is preferably subjected to an activation treatment such as a corona discharge treatment or a flame treatment. The surface of the support on the ink receiving layer side is glossy or matted depending upon its usage, but a glossy surface is preferable. The back side of the support is not necessarily covered with a resin, but it is preferably covered with a resin to prevent curling. The back surface of a support is ordinarily non-glossy, but the back surface or both surfaces of the support are optionally subjected to activation treatments such as a corona discharge treatment or a flame treatment. The thickness of a covered resin is not specifically limited, but ordinarily ranges from 5 to 50 μm.

A subbing or primer layer may be provided to improve the adhesion between the film support and the ink receiving layer. Subbing layers useful to this purpose are widely known in the photographic art and include, for example, vinylidene chloride polymers, such as vinylidene chloride/acrylo-nitrile/acrylic acid terpolymers or vinylidene chloride/methylacrylate/itaconic acid terpolymers.

In addition to the above mentioned ingredients, the ink receiving layer(s) can comprise other adjuvants dispersed in a binder. Useful additional adjuvants are represented by fillers, surfactants, mordants, matting agents, hardeners, plasticizers, and the like.

Organic and inorganic particles can be used as fillers. Useful filler examples are represented by silica (colloidal silica), alumina or alumina hydrate (aluminazol, colloidal alumina, a cation aluminum oxide or its hydrate and pseudo-boehmite), a surface-processed cation colloidal silica, aluminum silicate, magnesium silicate, magnesium carbonate, titanium dioxide, zinc oxide, calcium carbonate, kaolin, talc, clay, zinc carbonate, satin white, diatomaceous earth, synthetic amorphous silica, aluminum hydroxide, lithopone, zeolite, magnesium hydroxide and synthetic mica. Among these inorganic pigments, porous inorganic pigments are preferable such as porous synthetic silica, porous calcium carbonate and porous alumina.

Useful examples of organic fillers are represented by polystyrene, polymethacrylate, polymethyl-methacrylate, elastomers, ethylene-vinyl acetate copolymers, polyesters, polyester-copolymers, polyacrylates, polyvinylethers, polyamides, polyolefines, polysilicones, guanamine resins, polytetrafluoroethylene, elastomeric styrene-butadiene rubber (SBR), urea resins, urea-formalin resins. Such organic fillers may by used in combination, and/or instead of the above-mentioned inorganic fillers.

The above mentioned fillers are added to the ink receiving layer(s) in an amount from 0.1 to 5 g/m$^2$, preferably from 0.2 to 3.0 g/m$^2$, most preferably from 0.3 to 1 g/m$^2$.

Preferred examples of surfactants include anionic surfactants, amphoteric surfactants, cationic surfactants, and nonionic surfactants.

Examples of anionic surfactants include alkylsulfocarboxylates, α-olefin sulfonates, polyoxyethylene alkyl ether acetates, N-acylaminoacids and salts thereof, N-acylmethyltaurine salts, alkylsulfates, polyoxyalkylether sulfates, polyoxyalkylether phosphates, rosin soap, castor oil sulfate, lauryl alcohol sulfate, alkylphenol phosphates, alkyl phosphates, alkyl allyl sulfonates, diethylsulfosuccinates, diethylhexylsulfosuccinates and dioctylsulfosuccinates.

Examples of the cationic surfactants include 2-vinylpyridine derivatives and poly-4-vinylpyridine derivatives.

Examples of the amphoteric surfactants include lauryl dimethyl aminoacetic acid betaine, 2-alkyl-N-carboxymethyl-N-hydroxyethyl imidazolinium betaine, propyldimethylaminoacetic acid betaine, polyoctyl polyaminoethyl glycine, and imidazoline derivatives.

Useful examples of non-ionic surfactants include non-ionic fluorinated surfactants and non-ionic hydrocarbon surfactants. Useful examples of non-ionic hydrocarbon surfactants include ethers, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ethers, polyoxyethylene lauryl ethers, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene monooleate and polyoxyethylene stearate; and glycol surfactants. Specific examples of nonionic surfactants include octylphenoxy polyethoxy ethanols, such as Triton™ X-100, X-114 and X-405, available from Union Carbide Co., Danbury, Conn.; acetylenic diols such as 2,4,7,9-tetramethyl-5-decyn-4,7-diol and the like, such as Surfynol™ GA and Surfynol™ CT-136, available from Air Products & Chemicals Co., Allentown, Pa.; trimethyl nonylpolyethylene-glycol ethers, such as Tergitol™ TMN-10 (containing 10 oxyethylene units, believed to be of formula $C_{12}H_{25}O(C_2H_4O)_5H$), available from Union Carbide Co., Danbury, Conn.; non-ionic esters of ethylene oxide, such as Merpol™ SH (believed to be of formula $CH_3(CH_2)_{12}(OC_2H_4)_8OH$), available from E. I. Du Pont de Nemours & Co., Wilmington, Del.; non-ionic esters of ethylene oxide and propylene oxide, such as Merpol™ LFH (believed to be of formula $CH_3(CH_2)_n(OC_2H_4)_8(OC_3H_6)_8OH$, where n is an integer from 12 to 16), available from E. I. Du Pont de Nemours & Co., Wilmington, Del., and the like, as well as mixtures thereof. Non-limiting examples of non-ionic fluorinated surfactants include linear perfluorinated polyethoxylated alcohols (e.g., Zonyl™FSN, Zonyl™FSN-100, Zonyl™FSO, and Zonyl™FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylate (e.g., Fluorad™ FC-171 available from 3M, St. Paul, Minn.), fluorinated alkyl esters (e.g., Fluorad™ FC-430, FC-431, and FC-740 available from 3M, St. Paul, Minn.) and fluorine-substituted alkyl esters and perfluoroalkyl carboxylates (for example, the F-tergent series manufactured by Neos Co., Ltd., the Lodyne series manufactured by Ciba-Geigy, the Monflor series manufactured by ICI, the Surfluon series manufactured by Asahi Glass Co., Ltd., and the Unidyne series manufactured by Daikin Industries, Ltd.). Preferred nonionic fluorocarbon surfactants include Zonyl™ FSO, Fluorad™ FC-170C, and Fluorad™ FC-171.

The above mentioned non-ionic surfactants are added to the ink receiving layers in an amount from 0.01 to 1.0 g/m$^2$, preferably from 0.05 to 0.50 g/m$^2$.

Mordants may be incorporated in the ink-receptive layer of the present invention. Such mordants are represented by cationic compounds, monomeric or polymeric, capable of complexing with the dyes used in the ink compositions. Useful examples of such mordants include quaternary ammonium block copolymers, such as Mirapol A-15 and Mirapol WT available from Miranol Inc., Dayton, N.J., prepared as disclosed in U.S. Pat. No. 4,157,388, Mirapol AZ-1 available from Miranol Inc., prepared as disclosed in U.S. Pat. No. 4,719,282, Mirapol AD-1 available from Miranol Inc., prepared as disclosed in U.S. Pat. No. 4,157,388, Mirapol 9, Mirapol 95, and Mirapol 175 available from Miranol Inc., prepared as disclosed in U.S. Pat. No. 4,719,282, and the like. Other suitable mordants comprise diamino alkanes, ammonium quaternary salts (such as poly (vinylbenzyl quaternary ammonium salts disclosed in U.S. Pat. No. 4,794,067), and quaternary acrylic copolymer latexes.

Other suitable mordants are fluoro compounds, such as tetra ammonium fluoride hydrate, 2,2,2-trifluoroethylamine hydrochloride (Aldrich #18,038-6); 2,2,2-trifluoroethyltoluene sulfonate (Aldrich #17,782-2); 1-(α,α,α-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylaminehydrochloride, 2-fluoro-1-methyl pyridinium-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate.

Further mordants are monoammonium compounds as disclosed, for example, in U.S. Pat. No. 5,320,902, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), and N-cetyl, N-ethyl morpholinium ethosulfate (G-263 from ICI Americas).

Additional mordants are phosphonium compounds, such as, for example, those disclosed in U.S. Pat. No. 5,766,809, including bromomethyl triphenyl phosphonium bromide (Aldrich 26,915-8), 3-hydroxy-2-methyl propyl triphenyl phosphonium bromide (Aldrich 32,507-4), 2-tetraphenyl phosphonium bromide (Aldrich 21,878-2), tetraphenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of mordants include those disclosed in U.S. Pat. Nos. 5,760,809; 5,457,486; 5,314,747; 5,320,902 and 5,441,795.

The ink receiving layer can be hardened with a hardener in order to improve water resistance or dot reproduction. Examples of the hardener include aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed in U.S. Pat. No. 3,288,775, carbamoyl pyridinium compounds in which the pyridine ring carries a sulfate or an alkylsulfate group disclosed in U.S. Pat. Nos. 4,063,952 and 5,529,892, divinylsulfones, reactive olefin-containing compounds disclosed U.S. Pat. No. 3,635,718, N-methylol compounds disclosed in U.S. Pat. No. 2,732,316, isocyanates disclosed in U.S. Pat. No. 3,103,437, aziridine compounds disclosed in U.S. Pat. Nos. 3,017,280 and 2,983,611, carbodiimides disclosed in U.S. Pat. No. 3,100,704, epoxy compounds disclosed in U.S. Pat. No. 3,091,537, halogencarboxyaldehydes such as mucochloric acid, dioxane derivatives such as dihydroxy dioxane, and inorganic hardeners such as chromium alum, potash alum and zirconium sulfate. These hardeners can be used singly or in combination. The addition amount of hardener is preferably from 0.01 to 10 g, and more preferably from 0.1 to 5 g based on 100 g of a binder contained in the ink receiving layer.

The ink receiving layer may contain a matting agent in an amount of 0.005 to 0.3 g/m$^2$ in order to prevent adhesion defects such as blocking. The matting agents may be defined as particles of inorganic or organic materials capable of being discontinuously dispersed in a hydrophilic organic colloid. The inorganic matting agents include oxides such as silicon oxide, titanium oxide, magnesium oxide and aluminum oxide, alkali earth metal salts such as barium sulfate, calcium carbonate and magnesium sulfate, light-insensitive silver halide particles such as silver chloride and silver bromide (each of which may contain a small amount of iodine) and glass particles. Besides these substances there may be used inorganic matting agents which are disclosed in DE Patent 2,529,321, in GB Patents 760,775 and 1,260,772, U.S. Pat. Nos. 1,201,905, 2,192,241, 3,053,662, 3,062,649, 3,257,296, 3,322,555, 3,353,958, 3,370,951, 3,411,907, 3,437,484, 3,523,022, 3,615,554, 3,635,714, 3,769,020, 4,021,245 and 4,029,504. The organic matting agents include starch, cellulose esters such as cellulose acetate propionate, cellulose ethers such as ethyl cellulose and synthetic resins. The synthetic resins are water insoluble or sparingly soluble polymers which include an alkyl(meth) acrylate, alkoxyalkyl(meth)acrylate, glycidyl(meth)acrylate, (meth)acrylamide polymer, a vinyl ester such as vinyl acetate and acrylonitrile, an olefin such as ethylene or styrene and a copolymer of the above described monomers with other monomers such as acrylic acid, methacrylic acid, α,β-unsaturated dicarboxylic acid, hydroxyalkyl(meth) acrylate, sulfoalkyl(meth)acrylate and styrene sulfonic acid. Further, a benzoguanamin-formaldehyde resin, an epoxy resin, nylon, polycarbonates, phenol resins, polyvinyl carbazols or polyvinylidene chlorides can be used. Besides the above there may be used organic matting agents which are disclosed in GB Patent 1,055,713, in U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344,554, 3,591,379, 3,754,924 and 3,767,448, in JP Patents 49-106821/1974 and 57-14835/1982. These matting agents may be used alone or in combination.

The ink-receiving layer of the present invention can also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalic anhydride, urea phosphate, triphenylphosphate, glycerolmonostearate, propylene glycol monostearate, tetramethylene sulfone, N-methyl-2-pyrrolidone, N-vinyl-2-pyrrolidone, and polymer latices with low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan 90 available from Buckman Laboratories); 3,5-dimethyl tetrahydro-2H-1,3,5-thiadiazine-2-thione (Slime-Trol RX-28 available from Betz Paper Chem Inc.; a nonionic blend of 5-chloro-2-methyl-4-isothiazoline-3-one, 75% by weight and 2-methyl-4-isothiazolin-3-one, 25% by weight (available as Amerstat 250 from Drew Industrial Division; Nalcon 7647 from Nalco Chemical Company; Kathon LX from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33% by weight, sodium dimethyl-dithiocarbamate, 33% by weight, and sodium ethylene bisdithiocarbamate, 33% by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cationic biocides, such as cationic poly(oxyethylene(dimethylamino)ethylene (dimethylamino)ethylene dichloride) (Busan 77 available from Buckman Laboratories Inc.); a cationic blend of bis (trichloromethyl) sulfone and a quaternary ammonium chloride (available as Slime-Trol RX-36 DPB865 from Betz Paper Chem. Inc.); and the like, as well as mixtures thereof. The biocide can be present in any effective amount; typically, the biocide is present in an amount of from 0.1 to 3% by weight of the coating, although the amount can be outside this range.

The ink receiving layer in the invention may further contain various conventional additives such as colorants, colored pigments, pigment dispersants, lubricants, permeating agents, fixing agents for ink dyes, UV absorbers, antioxidants, dispersing agents, anti-foaming agents, leveling agents, fluidity improving agents, antiseptic agents, brightening agents, viscosity stabilizing and/or enhancing agents, pH adjusting agents, anti-mildew agents, anti-fungal agents, agents for moisture-proofing, agents for increasing the paper stiffness and anti-static agents.

The above-mentioned various additives can be added ordinarily in a range of 0 to 10% by weight based on the solid content of the ink receiving layer composition.

As a coating method of an ink receiving layer coating solution, any conventional coating method (for example, a curtain method, an extrusion method, an air-knife method, a slide coating, a roll coating method, reverse roll coating, solvent extrusion, dip coating processes and a rod bar coating method) can be used.

The ink-receiving layer of the present invention is preferably coated on one side of the support as a plurality of at least two distinct layers, coated from different coating solutions. Most preferably, the ink-receiving layer of the present invention is coated on one side of the support as a plurality of three distinct layers, coated from different coating solutions. When preparing an ink-jet receiving sheet according to this invention, by coating two or more ink-receiving layers onto a support, it is possible to prepare an ink-receiving sheet with excellent properties, especially with respect to bleeding and mottle.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLES

Example 1

Sample 1 (reference). A receiving ink jet sheet was prepared using a support comprising a 170 g/m$^2$ weight paper base. A resin layer consisting of a low density 170 g/m$^2$ weight polyethylene is coated on both sides of such paper base. A gelatin primer was coated on the front side and an anticurl gelatin layer was coated on the back side.

Three different coating solutions were coated all at once with an extrusion system at 10.6 meter per minute on the front side of the aforementioned support.

The resulting coating was dried to give a multilayer inkjet receiving sheet with the following composition:

First layer: 2.89 g/m$^2$ of gelatin and 0.06 g/m$^2$ of Triton™ X-100;

Second layer: 2.74 g/m$^2$ of gelatin and 0.15 g/m$^2$ of Triton™ X-100;

Third layer: 0.47 g/m$^2$ of gelatin, 0.07 g of Zonyl™ FSN100, and 0.04 g/m$^2$ of hardening agent H-1.

Sample 2 (invention). The procedure of sample 1 was repeated with the same ingredients, except that the three coating solutions comprised an amount of Glucidex-6™ polysaccharide to obtain a coverage of 0.47 g/m$^2$ in the resulting first layer, 1.52 g/m$^2$ in the resulting second layer and 0.11 g/m$^2$ in the resulting third layer.

The glossiness was measured on unprinted samples 1 and 2 at an angle of 60° with a TRI-Microgloss-160 (produced by Sheen) as disclosed in ASTM standard No. 523. The results are summarized in the following Table 1.

TABLE 1

| Sample | Polysaccharide | g/m² I Layer | II Layer | III Layer | Glossiness 60° C. |
|---|---|---|---|---|---|
| 1 (Ref.) | — | — | — | — | 83.6 |
| 2 (Inv.) | Glucidex-6 ™ | 0.47 | 1.52 | 0.11 | 90.9 |

The data of Table 1 clearly show that the introduction of Glucidex-6™ allows the improvement of the glossiness of the ink-jet receptor.

Example 2

Sample 3 (reference). A receiving ink jet sheet was prepared using a support comprising a paper base having weight of 170 g/m² in which a resin layer having a weight of 25 g/m² of low density polyethylene is coated on both sides. A gelatin primer was coated on the front side and an anticurl gelatin layer was coated on the back side.

Three different coating solutions were coated all at once with an extrusion system at 10.6 meter per minute on the front side of the aforementioned support.

The resulting coating was dried to give a multilayer inkjet receiving sheet with the following composition:

First layer: 3.60 g/m² of gelatin and 0.06 g/m² of Triton™ X-100;

Second layer: 3.60 g/m² of gelatin, 0.54 g/m² of fine particles of aluminum oxide, and 0.11 g/m² of Triton™ X-100;

Third layer: 0.84 g/m² of gelatin, 0.07g of Zonyl™ FSN100, and 0.04 g/m² of cross-linking agent H-1.

Samples 4–7 (invention). The procedure of sample 3 was repeated with the same ingredients, except that the three coating solutions comprised an amount of different polysaccharides according to the following Table 2 to obtain samples 4 to 7 having a polysaccharide coverage of 0.57 g/m² in the resulting first layer, 0.56 g/m² in the resulting second layer and 0.13 g/m² in the resulting third layer. The glossiness was measured as in Example I and the data are reported in Table 2.

TABLE 2

| Ex. | Polysaccharide | g/m² I Layer | II Layer | III Layer | Glossiness 60° C. |
|---|---|---|---|---|---|
| 3 (Ref.) | — | — | — | — | 79.1 |
| 4 (Inv.) | Glucidex-2 ™ | 0.57 | 0.56 | 0.13 | 88.3 |
| 5 (Inv.) | Glucidex-6 ™ | 0.57 | 0.56 | 0.13 | 89.7 |
| 6 (Inv.) | Glucidex-12 ™ | 0.57 | 0.56 | 0.13 | 89.8 |
| 9 (Inv.) | Glucidex-19 ™ | 0.57 | 0.56 | 0.13 | 86.8 |

The data of Table 2 clearly show that the introduction of polysaccharides into the ink-jet receiving sheet of the invention gives a better value of glossiness.

Triton™ X-100 is the trade name of a non-ionic surfactant of the alkylphenoxyethylene type having a dynamic surface tension of 32 dyne/cm² and corresponding to the following formula:

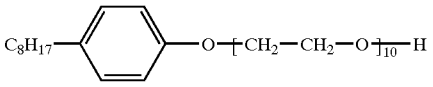

Zonyl™ FSN 100 is the trade name of a non-ionic surfactant of the perfluoroalkylpolyoxyethylene type, manufactured by DuPont having a dynamic surface tension of 26 dyne/cm² and corresponding to the following formula:

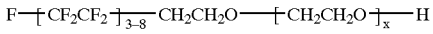

Cross-linking agent H-1 is a pyridinium derivative having the following formula:

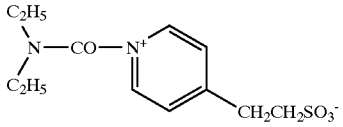

Glucidex-2™, Glucidex-6™, Glucidex-12™ and Glucidex-19™ are the trade names of polysaccharides available from Roquette Freres S.A., Lille, France.

What is claimed is:

1. An ink jet receiving sheet comprising a support and at least one ink receiving layer, characterized in that said ink receiving layer comprises a binder selected from the group consisting of gelatin and gelatin derivatives and at least one saccharide derivative selected from the group consisting of mono-, oligo-, or poly-saccharides having an average molecular weight ranging from 1,000 to 30,000 and obtained by enzymatic processing of natural polysaccharides.

2. The ink jet receiving sheet according to claim 1, characterized in that said binder is selected from the group consisting of pig skin gelatin, cow skin gelatin, cow bone collagen, lime-processed gelatin, acid processed gelatin, amino group inactivating gelatin, acetylated gelatin, phthaloylated gelatin, malenoylated gelatin, benzoylated gelatin, succinoylated gelatin, methyl urea gelatin, phenylcarbamoylated gelatin, and carboxy modified gelatin.

3. The ink jet receiving sheet of claim 2 having at least two ink jet receiving layers, with one of the at least two ink jet receiving layers being an outermost ink jet receiving layer of said at least two ink jet receiving layers and the outermost ink jet receiving layer having an ink jet printed image thereon.

4. The ink jet receiving sheet according to claim 1, characterized in that said binder is added in an amount ranging from 1 to 20 g/m².

5. The ink jet receiving sheet of claim 4 having at least two ink jet receiving layers, with one of the at least two ink jet receiving layers being an outermost ink jet receiving layer of said at least two ink jet receiving layers and the outermost ink jet receiving layer having an ink jet printed image thereon.

6. The ink jet receiving sheet according to claim 1, characterized in that said mono-, oligo-, or poly-saccharides comprise a recurring unit selected from the group consisting of glucose, xylose, mannose, arabinose, galactose, sorbose, fructose, fucose, adonitol, arbitol, inositol, xylitol, dulcitol, iditol, lactitol, mannitol, sorbitol, and a combination thereof.

7. The ink jet receiving sheet of claim 6 having at least two ink jet receiving layers, with one of the at least two ink jet receiving layers being an outermost ink jet receiving layer of said at least two ink jet receiving layers and the outermost ink jet receiving layer having an ink jet printed image thereon.

8. The ink jet receiving sheet according to claim 1, characterized in that said saccharide derivative is added in amount ranging from 0.1 to 5 g/m².

9. The ink jet receiving sheet of claim 8 having at least two ink jet receiving layers, with one of the at least two ink jet receiving layers being an outermost ink jet receiving layer of said at least two ink jet receiving layers and the outermost ink jet receiving layer having an ink jet printed image thereon.

10. The ink jet receiving sheet according to claim 1, characterized in that said receiving sheet comprises at least two adjacent ink receiving layers coated on the same side of the support, said adjacent ink receiving layers each comprising a binder amount ranging from 0.5 to 10 $g/m^2$, and a saccharide derivative amount ranging from 0.05 to 2.5 $g/m^2$.

11. The ink jet receiving sheet of claim 10 having at least two ink jet receiving layers, with one of the at least two ink jet receiving layers being an outermost ink jet receiving layer of said at least two ink jet receiving layers and the outermost ink jet receiving layer having an ink jet printed image thereon.

12. The ink jet receiving sheet of claim 1 having at least two ink jet receiving layers, with one of the at least two ink jet receiving layers being an outermost ink jet receiving layer of said at least two ink jet receiving layers and the outermost ink jet receiving layer having an ink jet printed image thereon.

* * * * *